US007452219B2

(12) United States Patent
Kitajima et al.

(10) Patent No.: US 7,452,219 B2
(45) Date of Patent: Nov. 18, 2008

(54) FLAT EARTH TERMINAL AND METHOD OF SURFACE-MOUNTING SAME

(75) Inventors: Yoshikazu Kitajima, Kawagoe (JP); Toshihiro Hatakeyama, Shiki (JP)

(73) Assignee: Kyoshin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/705,767

(22) Filed: Feb. 14, 2007

(65) Prior Publication Data

US 2007/0197087 A1 Aug. 23, 2007

(30) Foreign Application Priority Data

Feb. 20, 2006 (JP) ..... 2006-042403
Jan. 25, 2007 (JP) ..... 2007-014635

(51) Int. Cl.
*H01R 13/648* (2006.01)

(52) U.S. Cl. ..... 439/92; 439/83; 439/108

(58) Field of Classification Search ..... 439/92, 439/83, 108

See application file for complete search history.

(56) References Cited

U.S. PATENT DOCUMENTS

| | | | | |
|---|---|---|---|---|
| 3,530,231 | A * | 9/1970 | Penoyer | 174/261 |
| 5,395,250 | A | 3/1995 | Englert, Jr. et al. | |
| 7,357,645 | B2 * | 4/2008 | Jeong et al. | 439/66 |
| 2004/0121659 | A1 | 6/2004 | Saito et al. | |

FOREIGN PATENT DOCUMENTS

| | | | |
|---|---|---|---|
| CN | 1040053 | C | 9/1998 |
| DE | 31 01 931 | A1 | 9/1982 |
| JP | 2863981 | | 6/1995 |

* cited by examiner

*Primary Examiner*—Truc T Nguyen
(74) *Attorney, Agent, or Firm*—Birch, Stewart, Kolasch & Birch, LLP

(57) ABSTRACT

A flat earth terminal in the shape of a flat plate includes a main part with a screw insertion hole and a leg-like terminal part continuously extending from an end of the main part. A recess is formed on a mounting side of the flat earth terminal intended to be located on a printed circuit board, in a proximal portion of the terminal part continuously extending from the main part, to separate a distal portion of the terminal part from the main part. By this, solder is prevented from flowing from the terminal part to the main part, with certainty, so that a stable electric connection between the main part and the printed circuit board is ensured.

11 Claims, 3 Drawing Sheets

FLAT EARTH TERMINAL AND METHOD OF SURFACE-MOUNTING SAME

BACKGROUND OF THE INVENTION

1. Field of the Invention

This invention relates to a flat earth terminal which is mounted on a printed circuit board incorporated in a chassis of an electronic apparatus, so as to electrically connect the printed circuit board and the chassis, and a method of surface-mounting the flat earth terminal onto the printed circuit board.

2. Description of the Related Art

In electronic apparatuses of various types, it is necessary to stabilize the reference potential of a printed circuit board incorporated in a chassis, by connecting an earth line of the printed circuit board to the chassis. For such earthing, exclusively an earth terminal designed to be surface-mounted on the printed circuit board and screwed to the chassis with the printed circuit board is used.

A typical example of this type of the earth terminal is disclosed in Japanese Patent No. 2863981, for example. The earth terminal disclosed therein comprises a plate-like main part with a screw insertion hole (round hole) in the center, and leg-like terminal parts continuously extending from an end of the main part. The terminal parts are portions intended to be soldered to the printed circuit board. The earth terminal of this particular structure is called a flat earth terminal.

The flat earth terminal is surface-mounted onto the printed circuit board exclusively by soldering the flat earth terminal to conductive sections provided on the printed circuit board in advance. Specifically, the surface-mounting of the flat earth terminal is carried out as follows: On the printed circuit board, in a region in which the earth terminal is to be mounted, conductive sections are provided in advance to correspond to the leg-like terminal parts, and also to corners of the main part, as necessary; Then, the terminal parts and perhaps also corners of the main part of the flat earth terminal placed on the printed circuit board are soldered to the conductive sections.

In the surface-mounting, however, sometimes solder flows to between the main part of the flat earth terminal and the printed circuit board. If solder flows up to a region surrounding the screw insertion hole of the main part of the earth terminal, which region is referred to as a "screwing region", the state of contact between the earth terminal and the printed circuit board in the screwing region changes with a temporal change of the solder, which damages the effect of earthing using this earth terminal.

In the earth terminal (lug terminal) disclosed in the above-mentioned Japanese Patent, the terminal parts (leads) have end portions bent into a chevron shape. Thus, melted solder flows to under the chevron-shaped portions, but does not get under the main part (rectangular part) of the earth terminal. Consequently, the earth terminal is prevented from being raised by the solder getting under the main part.

However, since this earth terminal has chevron-shaped portions, if the chevron-shaped portions are formed with low accuracy, the earth terminal cannot be kept in a horizontal position but takes a tilted position. This causes problems such that the earth terminal is not sucked by a chip mounter in a good manner in the surface-mounting process, and that the chevron-shaped portions protruding upward obstruct the chip mounter's sucking operation. Further, when the flat earth terminal and its position should be recognized in an image formed by a camera, it is difficult to focus the camera on the flat earth terminal. Further, when the earth terminal is mounted on the side of a printed circuit board which faces a chassis, it is difficult to bring the main part in close contact with the chassis.

Publication DE-A-3101031 also discloses an earth terminal comprising a main part with a screw insertion hole and leg-like terminal parts (5). However, the leg-like terminal parts (5) are each passed through a hole in a circuit board and soldered to a conductor on the circuit board. Thus, this earth terminal anticipates a basically different manner of soldering than a Surface-mounted type earth terminal to which the present invention relates. Publication U.S. Pat. No. 5,395,350 discloses a terminal with a recess formed between a main part and a terminal part to prevent solder from flowing from the terminal part to the main part. However, this terminal belongs to a technique concerning a connector, and is irrelevant to a technique for surface-mounting on a printed circuit board to which the present invention relates.

SUMMARY OF THE INVENTION

In order to solve the above problem, the present invention intends to provide a flat earth terminal of a simple structure that can prevent solder from flowing to a screwing region of a main part thereof with certainty, thereby ensuring a stable electric connection between the earth terminal and a printed circuit board in the screwing region.

The present invention also intends to provide a surface-mounting method that can surface-mount a flat earth terminal of the above-mentioned structure onto a printed circuit board stably and with certainty.

In order to achieve the above object, a flat earth terminal according to the present invention comprises a main part with a screw insertion hole and a leg-like terminal part continuously extending from an end of the main part, the main part being a plate-like part including an area intended to be used as a spot at which a sucking nozzle sucks the flat earth terminal in surface mounting, and the leg-like terminal part being adapted to be connected to a printed circuit board and being substantially flat and level with the main part, and a recess being formed on a mounting side of the flat earth terminal intended to be located on a printed circuit board, in a proximal portion of the terminal part continuously extending from the main part, to separate a distal portion of the terminal part from the main part.

Desirably, the recess is formed by performing pressing work on the mounting-side surface of the proximal portion of the terminal part to impart a shape of a groove traversing the proximal portion of the terminal part.

In a method of surface-mounting a flat earth terminal according to the present invention, in advance of surface-mounting a flat earth terminal having the above-described structure onto a printed circuit board, a solder resist is screen-printed on the printed circuit board with a resin ink of low solder wettability, in a region in which the flat earth terminal is to be surface-mounted, at least at a location intended to correspond to the recess formed in the flat earth terminal.

Desirably, the solder resist is a frame-like pattern adapted to surround a region around the screw insertion hole of the main part of the flat earth terminal, locally separating corners of the main part from the main part and separating the terminal part from the main part.

In the case of the flat earth terminal having the above-described structure, since the flat earth terminal is in the shape, of a flat plate, as a whole including of the leg-like terminal part, it is easy to keep the flat earth terminal in a horizontal position without tilting it when the flat earth terminal is sucked by a sucking nozzle applied to the main part.

Further, when the flat earth terminal and its position should be recognized in an image formed by a camera, the camera can be easily and accurately focused on the flat earth terminal. Further, the leg-like terminal part does not obstruct the sucking nozzle's sucking operation. Furthermore, when the flat earth terminal is surface-mounted onto a printed circuit board by supplying solder to between the terminal part and the printed circuit board, the solder is prevented from flowing beyond the terminal part, since the recess produces an increased space between the flat earth terminal and the printed circuit board. In other words, the recess prevents the solder from flowing from the terminal part to the main part of the flat earth terminal.

This ensures that solder is supplied only to between the terminal part of the flat earth terminal and a conductive section of the printed circuit board, so that the flat earth terminal is surface-mounted on the printed circuit board firmly, and that the flat earth terminal and the printed circuit board are electrically connected reliably at the solder joint. Since the solder is prevented from reaching a screwing region, namely a region around the screw insertion hole of the main part of the earth terminal, stable contact can be created between the earth terminal, the printed circuit board and a chassis, in the screwing region, by screwing the printed circuit board with the earth terminal mounted on, to the chassis. In other words, since solder does not exist in the screwing region, the problem with the prior art such that the state of contact in the screwing region changes due to a temporal change of solder under the pressure exerted by screwing can be obviated effectively. Thus, the problem such that the effect of earthing the printed circuit board using the earth terminal is damaged does not happen.

Thus, the present invention provides a flat earth terminal which can obviate the problems caused by solder flowing from the terminal part to the main part and which allows a chip mounter to suck it in a good manner in the surface-mounting process, and a method of surface-mounting the same.

Further, since the flat earth terminal is in the shape of a flat plate, as a whole including the leg-like terminal part, even when the flat earth terminal is mounted on the side of a printed circuit board which faces a chassis, the main part can be brought in close contact with the chassis.

Also the solder resist screen-printed on the printed circuit board with a resin ink of low solder wettability, in advance, at least at the location intended to correspond to the recess formed in the flat earth terminal can prevent the flowing-out (flowing-in) of solder. Due to the solder flowing-out (flowing-in) prevention function of the solder resist combined with that of the recess, further reliable surface-mounting of the flat earth terminal can be achieved. Consequently, stable contact between the earth terminal, the printed circuit board and the chassis in the screwing region can be maintained for a long period of time.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Referring to the attached drawings, an embodiment of flat earth terminal according to the present invention and a method of surface-mounting the same will be described below.

Figure 1:
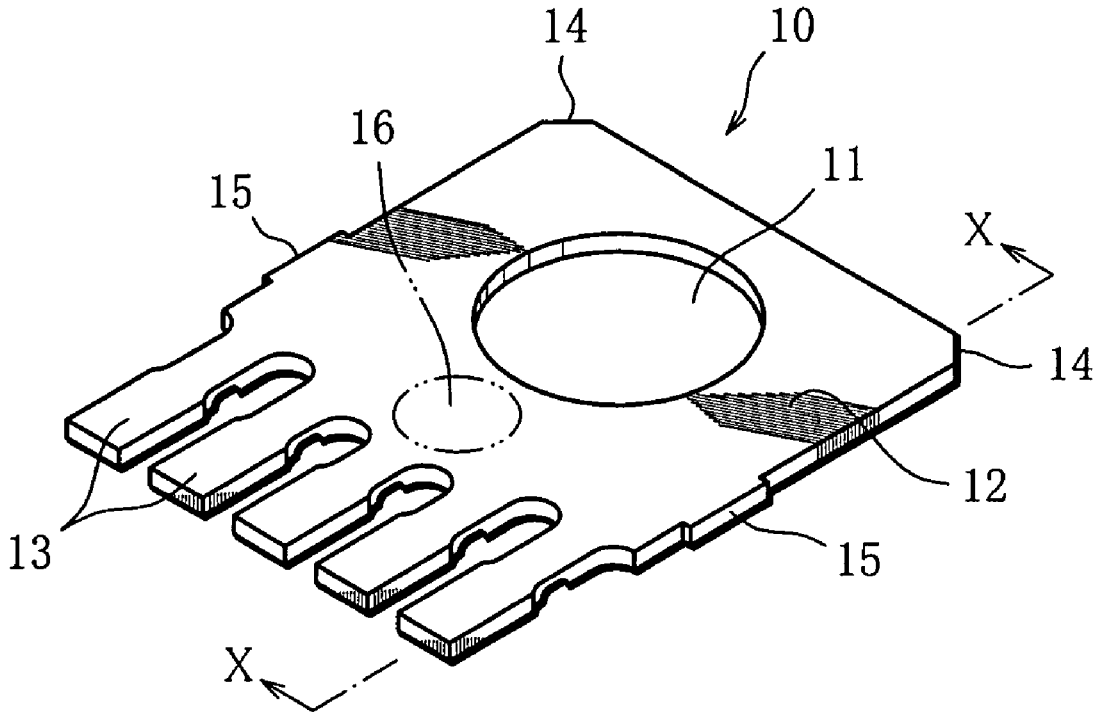
FIG. 1 is a perspective view showing an example of embodiment of flat earth terminal according to the present invention.

FIG. 1 is a perspective view showing a schematic structure of an embodiment of flat earth terminal. A flat earth terminal 10 is a component in the shape of an almost rectangular flat plate, obtained by cutting, for example a copper alloy plate of thickness 0.3 mm to a size approximately 10 mm×8 mm. Specifically, the flat earth terminal 10 comprises a main part 12 with a screw insertion hole (round hole) 11 of diameter 4 mm located nearer to an end of its length, and 5 parallel leg-like terminal parts 13 of width approximately 1 mm at the opposite end of the main part 12 formed by providing 4 cuts. Each terminal part 13 is narrowed at the proximal portion since each cut has an ellipsis-like shape near the bottom. The distal portion of each terminal part 13, separated from the main part 12 by the narrowed proximal portion, is a portion intended to be soldered to a printed circuit board.

The almost rectangular main part 12 has chamfered corners 14 (sloping at approximately 45°), each formed by cutting away a triangle of two equal sides of 0.5 mm or so. The chamfered corners 14 are portions intended to be soldered to a printed circuit board as will be described later. Projections 15 at both lateral sides of the main part 12 are what used to be connecting portions. Specifically, a plurality of flat earth terminals 10 are manufactured in one block (by press working), where they are connected laterally at the connecting portions 15. By cutting at the connecting portions, individual earth terminals 10 are separated.

Among the cuts provided for forming the terminal parts 13, two inside cuts are smaller in depth. Due to the difference in depth between the outside cuts and the inside cuts, there is provided an area 16 indicated by an imaginary line in the drawing between the inside cuts and the screw insertion hole 11 of the main part 12. The area 16 is intended to be used as a spot at which a sucking nozzle (not shown) sucks the flat earth terminal 10 when the flat earth terminal 10 is surface-mounted onto a printed circuit board using a chip mounter.

Figure 2:
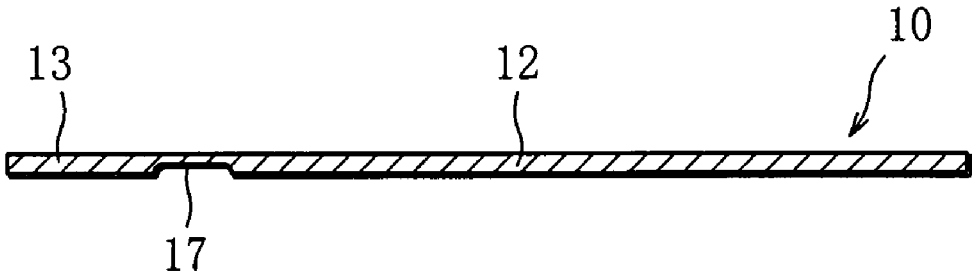
FIG. 2 is a diagram showing a cross-sectional structure of the flat earth terminal shown in FIG. 1.

The characteristic feature of the flat earth terminal 10 according to the present invention having the above-described basic structure lies in that the rear side of the flat earth terminal 10 cut out by pressing work, therefore a so-called burred surface is intended as a mounting side located on a printed circuit board, and that, on the mounting side, a recess 17 is formed at the proximal portion of each terminal part 13 such that the recess separates the distal portion of each terminal part 13 from the main part 12, as seen from the cross-sectional structure shown in FIG. 2.

The recess 17 is formed, for example by performing pressing work on the mounting-side surface of the proximal portion of each terminal part 13 to impart a shape of a groove traversing the proximal portion. The recess 17 measures, for example approximately 0.05 mm in depth and approximately 0.4 to 1.0 mm in width. A similar recess may be formed near each chamfered corner 14 to extend along the chamfered corner 14. The recesses 17 have a function of locally increasing a space between the mounting-side surface of the flat earth terminal 10 and the surface of a printed circuit board, thereby preventing solder from flowing to the main part 12 as will be described later.

Figure 3:
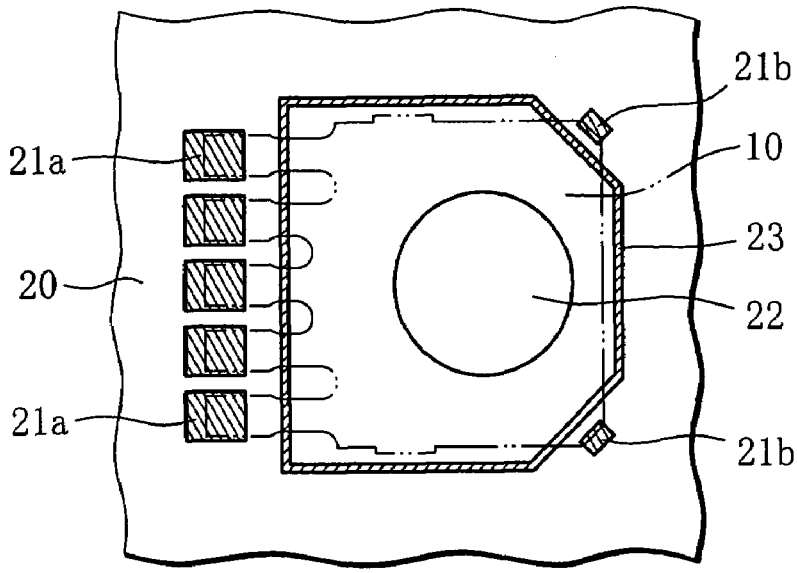
FIG. 3 is a diagram relating to an embodiment of method of surface-mounting a flat earth terminal according to the present invention, and showing an example of formation of conductive sections, and a solder resist screen-printed with resin ink, on a printed circuit board on which the flat earth terminal of FIG. 1 is to be mounted.

In the surface-mounting method according to the present invention, in advance of surface-mounting the above-described flat earth terminal 10 onto a printed circuit board 20, conductive sections 21 (21*a* and 21*b*) to which the flat earth terminal 10 is to be soldered are provided on the printed circuit board 20, in a region in which the earth terminal 10 is to be mounted, specifically at locations intended to correspond to the terminal parts 13 and chamfered corners 14 of the flat earth terminal 10. Referring to an example of arrangement of conductive sections 21 on the printed circuit board 20 in FIG. 3, rectangular conductive sections 21*a* are provided in a row to Correspond to the 5 terminal parts 13 of the flat earth terminal 10, and conductive sections 21*b* are provided to correspond to the 2 chamfered corners 14 of the main part 12 of the flat earth terminal 10. The locations of these conductive sections 21 (21*a*, 21*b*) are determined to satisfy the condition that the flat earth terminal 10 should be positioned on the printed circuit board 20 with the screw insertion hole 11 being almost coaxial with a round hole 22 provided in the printed circuit board 20 for fixing to a chassis.

Then, a solder resist 23 running between the conductive sections 21 (21*a*, 21*b*) and the region in which the main part 12 of the flat earth terminal 10 is to be positioned, more specifically, traversing the regions corresponding to the recesses 17, is screen-printed on the printed circuit board 20 with a resin ink of low solder wettability. As in an example shown in FIG. 3, the solder resist (screen-printed resist) 23 can be provided on the printed circuit board 20, in the region in which the flat earth terminal 10 is to be surface-mounted, as a frame-like pattern adapted to surround the main part 12 of the flat earth terminal 10, locally separating the chamfered corners 14 from the main part 12, and separating the terminal parts 13 from the main part 12.

In other words, the solder resist (screen-printed resist) 23 is provided to define a region which surrounds the round hole 22 for fixing to the chassis and which is a specified distance away from each conductive section 21 (21*a*, 21*b*), as a solder excluding region. The resin ink of low solder wettability with which the solder resist 23 is screen-printed is, for example made of an electrically-insulating epoxy resin.

Figure 4:
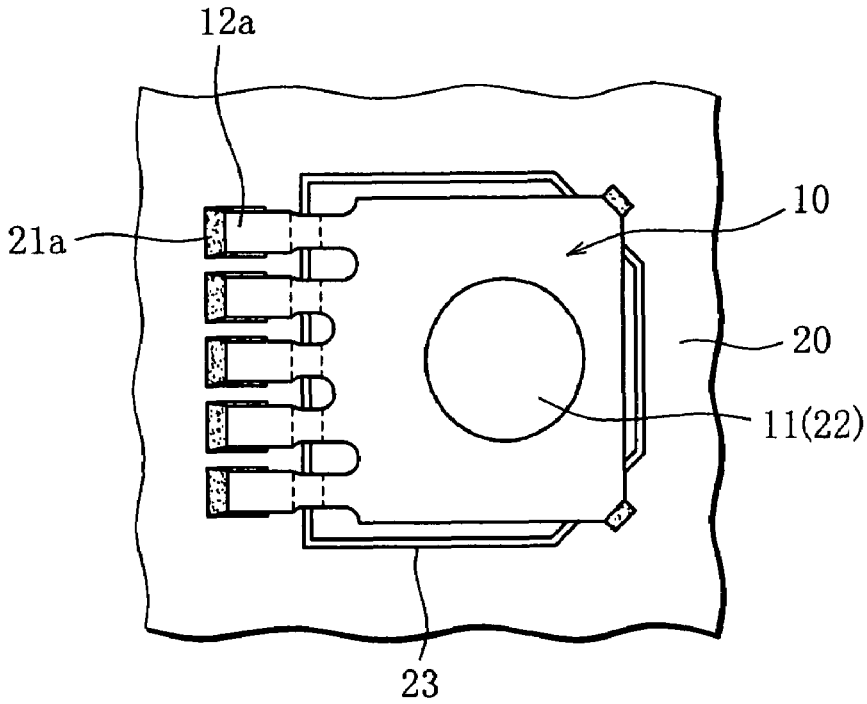
FIG. 4 is a diagram showing how the flat earth terminal is surface-mounted on the printed circuit board.

After forming the conductive sections 21 (21*a*, 21*b*) and solder resist 23 on the printed circuit board 20, then the flat earth terminal 10 is placed on the printed circuit board 20 with the screw insertion hole 11 aligned with the round hole 22 for fixing to the chassis, and with the terminal parts 13 located on the conductive sections 21*a*. Then, as shown in FIG. 4, the terminal parts 13 of the flat earth terminal 10 are soldered to the conductive sections 12*a*, and the chamfered corners 14 of the main part 12 are soldered to the conductive sections 21*b*. Thus, the surface-mounting of the flat earth terminal 10 onto the printed circuit board 20 is completed.

Figure 5:
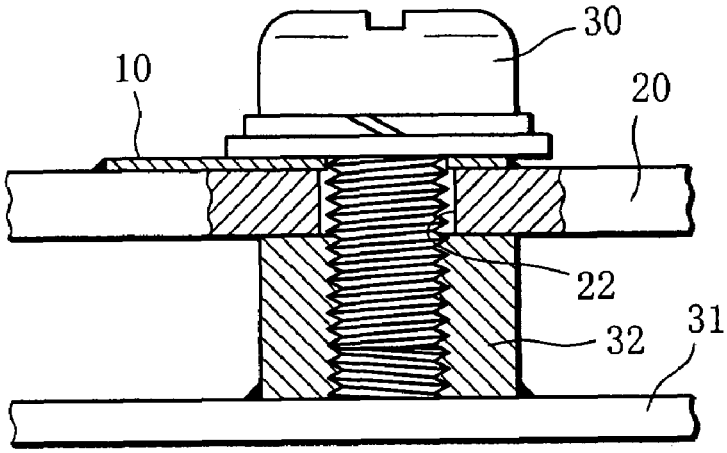
FIG. 5 is a diagram showing how the printed circuit board with the flat earth terminal surface-mounted on is screwed to a chassis.

The printed circuit board 20 with the flat earth terminal 10 surface-mounted on is attached to the chassis 31, for example using a screw 30 with a washer as shown in FIG. 5. Specifically, the printed circuit board 20 with the flat earth terminal 10 surface-mounted on is placed on a board attachment projection (boss) 32 provided on the chassis 31. Then, the screw 30 with the washer is inserted into the screw insertion hole 11 and round hole 22, from above the flat earth terminal 10 surface-mounted on the printed circuit board 20. Then, by fastening the screw 30 with the washer to the board attachment projection (boss) 32 provided on the chassis 31, the printed circuit board 20 is joined to the chassis 31.

In this method of surface-mounting onto the printed circuit board 20 having the above-described structure, in the step of soldering the terminal parts 13 and chamfered corners 14 of the flat earth terminal 10 to the conductive sections 21 (21*a*, 21*b*) of the printed circuit board 20, melted solder supplied to the to-be-soldered portions flows only to between the underside of the flat earth terminal 10 and the conductive sections 21 of the printed circuit board 20 due to solder wettability and surface tension.

At this time, even if the melted solder supplied to the conductive sections 21 is going to further flow to between the main part 12 and the printed circuit board 20, the surface tension does not allow the melted solder to spread beyond the terminal parts 13, since the main part 12 is separated by the recesses 17 which increase the space between the flat earth terminal and the printed circuit board 20. In addition, the solder resist 23 screen-printed on the printed circuit board 20 with the resin ink of low solder wettability to correspond to the recesses 17 prevents the solder from flowing out from the conductive sections 21 (21*a*, 21*b*).

Thus, the recesses 17 and the solder resist 23 screen-printed with the resin ink of low solder wettability prevent the solder from flowing to the underside of the main part 12, with certainty. Consequently, the solder spreads only between the conductive sections 21 (21*a*, 21*b*) and the terminal parts 13 and chamfered corners 14 of the flat earth terminal 10, thereby electrically connecting them as well as mechanically joining them firmly.

In other words, since the recesses 17 and the solder resist 23 prevent the solder from spreading, the solder does not flow to the underside of the flat earth terminal 10, specifically to the underside of the main part 12 thereof. Consequently, when the printed circuit board 20 with the flat earth terminal 10 surface-mounted on is attached to the chassis 31 using the screw 30 with the washer, solder does not exist in the screwing region (main part 12). Thus, the problem such that the state of contact in the screwing region changes, which damages the effect of earthing by the flat earth terminal 10, is not produced. Thus, the flat earth terminal 10 can achieve a stable electric connection between the printed circuit board 20 and the chassis 31.

Further, as mentioned above, in surface-mounting the flat earth terminal 10 onto the printed circuit board 20 by using a chip mounter, the earth terminal 10 is sucked by a sucking nozzle. Since the flat earth terminal 10 is in the shape of a flat plate, as a whole inclusive of the leg-like terminal parts 13, it is easy to keep the flat earth terminal 10 in a horizontal position without tilting it so as to be sucked by the sucking nozzle applied to the main part 12 in a good manner. Further, when the flat earth terminal 10 and its position should be recognized in an image formed by a camera, the camera can be easily and accurately focused on the flat earth terminal 10. Further, the leg-like terminal parts 13 do not obstruct the sucking nozzle's sucking operation.

Thus, the flat earth terminal 11 intended to be surface-mounted provides a flat earth terminal and method of surface-mounting the same which can obviate the problems caused by solder flowing from the terminal part to the main part and which allows a chip mounter to suck it in a good manner.

Figure 6:
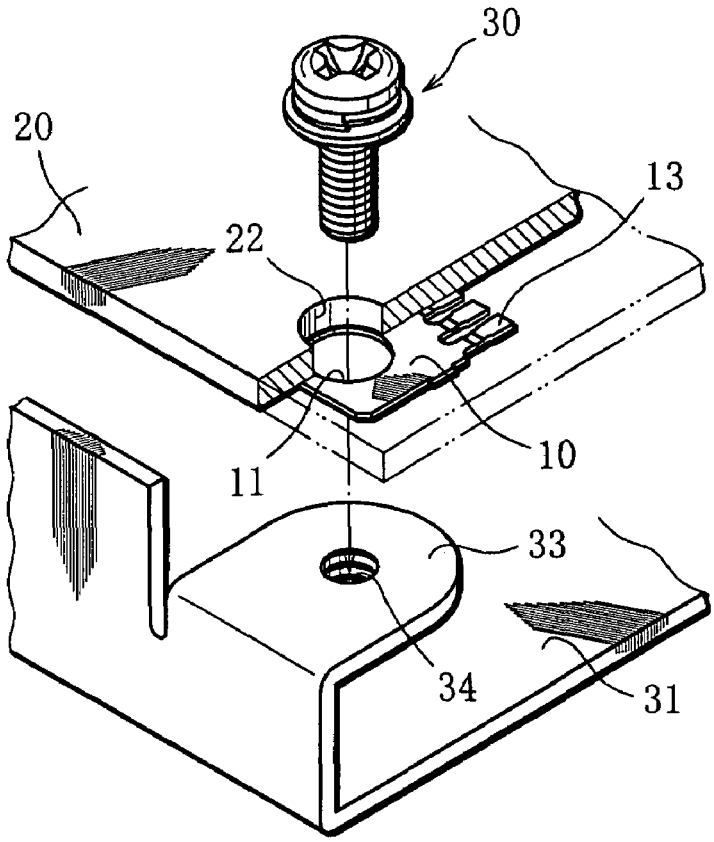
FIG. 6 is a diagram showing another manner of surface-mounting a flat earth terminal onto a printed circuit board.

The present invention is not restricted to the above-described embodiment. Although in the described embodiment, the printed circuit board 20 is fixed to the chassis 31 by inserting the screw 30 with the washer from above the flat earth terminal 10 soldered to the printed circuit board 20, it can be modified such that the flat earth terminal 10 is mounted on the rear side of the printed circuit board 20, as shown in FIG. 6. Specifically, it can be modified such that the flat earth terminal 10 is soldered to the surface of the printed circuit board 20 which faces the chassis 31, and that the printed circuit board 20 is placed on and screwed to a flange 33 provided to the chassis 31, with the flat earth terminal between them. Reference sign 34 denotes a threaded screw hole formed in the flange 33.

Also when this mode of attachment of the printed circuit board 20 to the chassis 31 is adopted, the flat earth terminal 10 according to the present invention is, as a whole, in the shape of a flat plate, although provided with recesses 17 between the main part 12 and the distal portions of the terminal parts 13. Thus, the close contact between the main part 12 of the flat earth terminal 10 and the printed circuit board 20 and between the main part 12 of the flat earth terminal 10 and the flange 33 is ensured. Since the solder is prevented from flowing to the main part 12 as mentioned above, mechanical close contact between the above parts as well as electric connection between them is maintained satisfactorily. Thus, the printed circuit board 20 can be incorporated into the chassis 31 with high reliability.

The solder resist (screen-printed resist) 23 can be modified, for example to surround each of the conductive sections 21 (21*a*, 21*b*), individually. Alternatively, the solder resist (screen-printed resist) 23 can be provided in the form of lines of a specified length which separate the conductive sections 21 (21*a*, 21*b*) from the region in which the main part 12 of the flat earth terminal 10 is to be positioned. The shape of the flat earth terminal 10 is not restricted to the above-described example. The depth, width, etc. of the recesses 17 formed in the flat earth terminal 10 may be designed according to the specifications thereof.

The invention thus described, it will be obvious that the same may be varied in many ways. Such variations are not to be regarded as a departure from the sprit and scope of the invention, and all such modifications as would be obvious to one skilled in the art are intended to be included within the scope of the following claims.

What is claimed is:

1. A flat earth terminal in the shape of a flat plate, comprising:

a main part;

a screw insertion hole passing through the main part;

a leg-like terminal part continuously extending from an end of the main part and to be connected to a printed circuit board, an entire portion of the leg-like terminal being substantially flat and level with the main part; and a recess formed on a mounting side of the flat earth terminal intended to be located on a printed circuit board, in a proximal portion of the terminal part continuously extending from the main part, to separate a distal portion of the terminal part from the main part.

2. A flat earth terminal according to claim 1, wherein the recess comprises a groove traversing the proximal portion of the terminal part.

3. A flat earth terminal according to claim 1, wherein the recess is formed by performing pressing work on the mounting side of the terminal part to impart a shape of a groove traversing the proximal portion of the terminal part.

4. The flat earth terminal of claim 1 wherein a surface of said main part and a surface of said leg-like terminal part are co-planar.

5. A method of surface-mounting a flat earth terminal onto a circuit board, comprising:

providing the flat earth terminal having a shape of a flat plate, the flat earth terminal including, a main part, a screw insertion hole passing through the main part, a leg-like terminal part continuously extending from an end of the main part and to be connected to the printed circuit board, an entire portion of the leg-like terminal being substantially flat and level with the main part, and a recess formed on a mounting side of the flat earth terminal intended to be located on a printed circuit board, in a proximal portion of the terminal part continuously extending from the main part, to separate a distal portion of the terminal part from the main part;

screen-printing a solder resist on the printed circuit board with a resin ink of low solder wettability, in a region in which the flat earth terminal is to be surface-mounted, at least at a location intended to correspond to the recess formed in the flat earth terminal; and mounting the flat earth terminal onto the printed circuit board.

6. The method of surface-mounting a flat earth terminal according to claim 5, wherein the step of screen printing the solder resist comprises, forming the solder resist as a frame-like pattern adapted to surround the main part of the flat earth terminal, locally separating corners of the main part from the main part and separating the terminal part from the main part.

7. A flat earth terminal in the shape of a flat plate, comprising:

a main part, a screw insertion hole passing through the main part, a plurality of leg-like terminal parts continuously extending in a longitudinal direction from an end of the main part and to be connected to a printed circuit board, each of said leg-like terminal parts including a distal portion spaced from said main part and a proximal portion between said distal portion and said main part, and the an entire portion of leg-like terminal being substantially flat and level with the main part, and a transverse groove formed across a mounting side of each of the flat earth terminal parts in the proximal portion of the terminal parts so as to substantially prevent a solder applied to the distal portion from flowing in the longitudinal direction from the distal portion onto the main part.

8. The flat earth terminal of claim 7 wherein a surface of said main part and a surface of said plurality of leg-like terminal parts are coplanar.

9. A method of surface mounting a flat plate earth terminal to a printed circuit board, where the flat plate earth terminal comprises:

a main part, a screw insertion hole passing through the main part, and a plurality of leg-like terminal parts continuously extending in a longitudinal direction from an end of the main part, each of said leg-like terminal parts including a distal portion spaced from said main part and a proximal portion between said distal portion and said main part, the method comprising:

forming each of the plurality of leg-like terminal parts to be connected to a printed circuit board, an entire portion of said each of the plurality of leg-like terminal parts being substantially flat and level with the main part;

forming a transverse groove across a mounting side of each of the flat earth terminal parts in the proximal portion of the terminal parts;

providing a resin ink of low solder wettability;

screen-printing a solder resist on the printed circuit board with the resin ink; and mounting the flat plate earth terminal on the printed circuit board with the recesses overlying the screen-printed solder resist.

10. The method of claim 9 wherein, said step of forming a transverse groove comprises the step of performing pressing work on the mounting-side surface of the proximal portion of the terminal part.

11. The method of claim 9 wherein, the flat plate earth terminal includes first and second corners and wherein said step of mounting the flat plate earth terminal on the printed circuit board comprises the step of mounting the flat plate earth terminal on the printed circuit board such that the first and second corners are separated from the screw hole by the solder resist.

* * * * *